US005130612A

United States Patent [19]

Lapatovich et al.

[11] Patent Number: 5,130,612

[45] Date of Patent: Jul. 14, 1992

[54] LOOP APPLICATOR FOR HIGH FREQUENCY ELECTRODELESS LAMPS

[75] Inventors: Walter P. Lapatovich, Marlborough; Scott J. Butler, N. Oxford; Jason R. Bochinski, Natick, all of Mass.

[73] Assignee: GTE Products Corporation, Danvers, Mass.

[21] Appl. No.: 757,798

[22] Filed: Sep. 11, 1991

[51] Int. Cl.[5] ..... H05B 41/16

[52] U.S. Cl. ..... 315/248; 315/344

[58] Field of Search ..... 315/248, 39, 344, 267; 313/234, 607, 153

[56] References Cited

U.S. PATENT DOCUMENTS

| | | | |
|---|---|---|---|
| 3,942,058 | 3/1976 | Haugsjaa et al. | 315/248 |
| 4,041,352 | 8/1977 | McNeill et al. | 315/248 |
| 4,266,162 | 5/1981 | McNeill et al. | 315/39 |
| 4,427,925 | 1/1984 | Proud et al. | 315/248 |
| 5,070,277 | 12/1991 | Lapatovich | 315/248 |

OTHER PUBLICATIONS

M. Schafer, U. Bochtier, R. Bitzer and F. Landstorter "Radiation Losses in Planar Filter Structures" Microwave Journal, Oct. 1989, pp. 139–143.

*Primary Examiner*—Eugene R. LaRoche
*Assistant Examiner*—A. Zarabian
*Attorney, Agent, or Firm*—Carl F. Ruoff; Victor F. Lohmann, III

[57] ABSTRACT

A high frequency applicator for energizing electrodeless lamps is described. The applicators are made of two loops of wire electrically attached to the ends of phased feed points of a planar transmission line. The loops are face each other and are positioned so as to form a gap in which a lamp capsule is placed. Each loop is made of three partial turns, the first and second turns being parallel to each other, each partial turn having a first and second end and the third partial turn is attached to the second end of each partial turn and positioned orthogonal the first and second turns. The plane formed by the third turn makes a dihedral angle between 9° and 135° with the planar transmission line.

7 Claims, 2 Drawing Sheets

LOOP APPLICATOR FOR HIGH FREQUENCY ELECTRODELESS LAMPS

BACKGROUND OF THE INVENTION

The present invention relates to a high frequency applicator for energizing electrodeless lamps. More specifically, an energy application system made of two loops of wire attached to the ends of phased feed points of a planar transmission line, and facing one another so as to make a gap between the loops is detailed. The electrodeless lamp is placed within the gap.

Applicators for energizing electrodeless discharges using planar transmission lines and helical couplers are described by Lapatovich in U.S. Pat. application Ser. No. 07/524,265. In this reference slow wave applicators made from helical coils are described which compress the electromagnetic wavelength inside the helix.

Cup-like termination fixtures for energizing electrodeless lamps are depicted by McNeill in U.S. Pat. No. 4,041,352 which shows single ended excitation, and in U.S. Pat. No. 4,266,162 which discloses double ended excitation. The more relevant patent is '162 in which McNeill is concerned with elongated sources, and in which he recites the virtues of double ended excitation (see col. 7, lines 54–68).

The present invention relates to a novel applicator for energizing electrodeless lamps.

SUMMARY OF THE INVENTION

The present invention relates to a coupling system for delivering microwave power to a lamp capsule. The system includes two loops of wire also called "hairpin" applicators, each formed from a first and second partial turn which form planes parallel to and separated from each other. A third partial turn connects the first and second partial turns and forms a plane which is orthogonal to the parallel planes formed by the first and second partial turns. The two hairpins are positioned so as to form a gap in which a lamp capsule is placed. Each hairpin is coupled to a planar transmission line which is coupled to RF power source. The system includes a ground plane parallel to the planar transmission line. The plane of the ground plane forms a dihedral angle of between 0° and 135° with the plane of the third partial turn of each hairpin. In a preferred embodiment, the planar transmission line forms a balun so that the hairpin applicators are 180° out of phase with each other.

For a better understanding of the present invention, together with other advantages and capabilities thereof, reference is made to the following detailed description and appended claims in connection with the preceding drawings and description of some aspects of the invention.

DETAILED DESCRIPTION OF THE PREFERRED EMBODIMENT

A high frequency applicator for energizing electrodeless lamps is described. The applicators are formed from two loops of wire electrically attached to the ends of phased feed points of a planar transmission line of the type described by in U.S. Pat. application Ser. No. 07/524,265 and facing one another so as to make a gap between the loops. The shaping of the loop establishes an electromagnetic field in the vicinity of the loop and in the gap between opposing loops. Such a field configuration is desirable for energizing an electrodeless discharge in a capsule placed within the gap formed by the opposing loops.

A quasi-TEM (transverse electromagnetic) wave propagating down the microstripline encounters a discontinuity where the planar line ends. In the absence of a loop, the reflection coefficient would approach infinity and the voltage at the discontinuity would increase. The discontinuity behaves like a magnetic dipole in the plane of the dielectric substrate as discussed by Schafer et al. (M. Schafer, U. Bochtler, R. Bitzer and F. Landstorfer, Microwave Journal, Oct. 1989 p. 139–143). The loop (also called a "hairpin") is formed so that a current path may be continued from the vicinity of the discontinuity so as to sustain the discontinuity, viz. the magnetic dipole. This permits the field to "leak-out" or propagate locally in an evanescent wave into the gap between loops wherein sits a lamp capsule to be energized. The diameter of the loops, the tuning gap (that is the close approach of the bottom turn of wire to the ground plane), and the wire diameter, assist in matching the circuit to the impedance of a particular lamp. Lamps were operated in the arc mode with performance similar to the lamps with helical couplers at both 915 MHz and 2.45 GHz using this technique.

Figure 1:
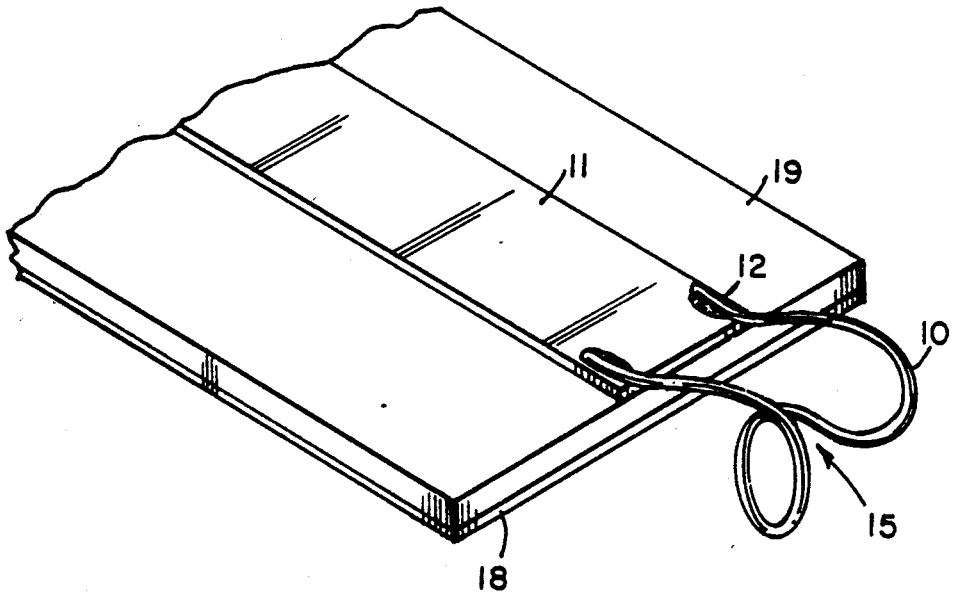
FIG. 1 shows the "hairpin" applicator of the present invention.

Further description of the invention is by way of reference to the encloses drawings. FIG. 1 shows the essential features of the "hairpin" or loop applicator 10. The loop applicator 10 is attached to the end of the microstripline 11 through a solder joint 12 or other suitable means. Not shown is the second loop applicator which forms a gap 15 where the lamp is positioned. The ground plane 18 is parallel to the microstripline and separated therefrom by the substrate 19.

Figure 2:
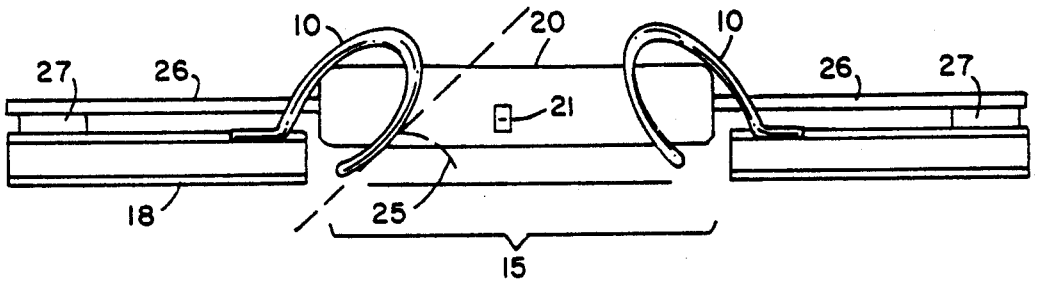
FIG. 2 shows a side view of the hairpin applicators of the present invention with an electrodeless lamp placed between the applicators.
Figure 3:
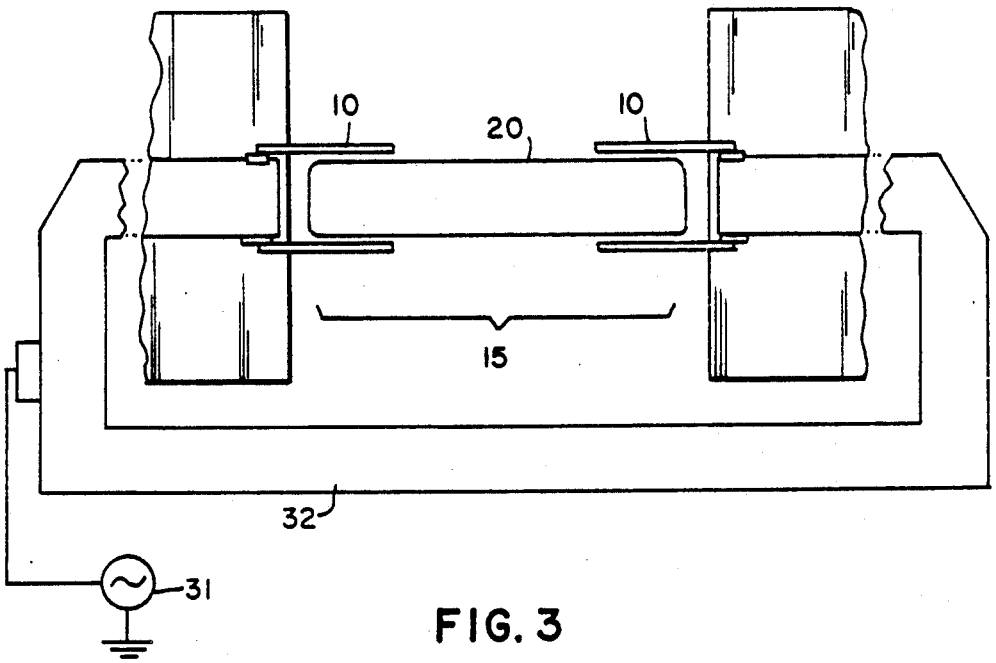
FIG. 3 shows a top view of the hairpin applicators of the present invention with an electrodeless lamp placed between the applicators.

FIGS. 2 and 3 show the lamp capsule positioned within the gap formed by facing "hairpin" loops 10. The lamp capsule 20 is not in contact with the loops 10 at any point. The individual hairpins 10 are formed by three partial turns. Two turns are in parallel planes perpendicular to the plane of the dielectric substrate and separated by a distance slightly larger than the lamp diameter. The distance between the wire and the lamp should be between 0.1 and 10 mm with the preferred separation of approximately 0.5 mm for a lamp designed for 25 W loading. The third partial turn is in a plane orthogonal to the first and second partial turns which makes a dihedral angle with the ground plane 18 of the circuit card. This dihedral angle 25 is between 0° and 135° and is adjustable, forming part of the tuning of the hairpin applicators to the lamp impedance. Also shown in FIG. 2 are lamp extensions 26 and lamp supports 27 which are used to securely hold the lamp 20 between the hairpins 10 of the present invention. Any suitable means may be used to securely position the lamp 20 between the hairpins 10.

The open nature of the "hairpin" loops 10 permits easy positioning of the lamp 20 within the gap 15 and is a new and desirable feature of the instant invention. The lamp is not surrounded substantially by metal either in the form of a solid surface (as in the end cups), or as a tightly wound helix. This is called minimal coupling and is a new and important feature of the instant invention. Because the structure is minimally opaque, more light from the source can be coupled to an optic such as a reflector. Additionally, the reduction of surface area reduces radiation losses of the electromagnetic energy, and scatters less of the optical energy providing less glare in the case of a source mated to an optic. Finally, the minimal coupling intercepts a minimal amount of heat radiation from the hot arc tube which is conducted back along the loops to the solder joints. A microwave source 31 coupled to a transmission line 32 delivers microwave power to the hairpin loops 10.

The lamp capsules used in the present disclosure were made of water-free quartz and had an outer diameter of 3 mm and an inner diameter of 2 mm. The internal length of the capsules were approximately 10 mm. However, lamps of other dimensions are easily powered by the applicators of the present invention.

The lamp capsule 20 encloses a lamp fill 21 that may include various additional doping materials as are known in the art. The lamp fill 21 composition is chosen to include at least one material that is vaporizable and excitable by radio frequency power. The lamp fill compositions useful in the present invention are those familiar in arc discharge tubes. The preferred gas is a Penning mix of largely neon with a small amount (1%) of argon although xenon, kryptron, argon or pure neon may be used. The lamp fill preferably includes a metallic compound such as a metallic salt. Scandium iodide is one such salt.

The lamp fill used in the lamp capsule is approximately 0.3 milligrams of mercury, 0.1 milligram of sodiumscandium iodide with a Penning gas mixture at about twenty torr. The Penning gas mixture consisted of approximated 0.005% argon in neon.

By way of illustration, and not as a limitation of the present invention, the wire material which forms the first and second loop applicators may be selected from the group consisting of copper, nickel, and tungsten.

While the loop shown here is made from wire, it should be obvious to one skilled in the art that a loop from a thin, flat conductor could also be used. Additionally, the first and second loop applicators may be made from tungsten gold alloy, or a high temperature superconducting ceramic. The use of the word "hairpin" is descriptive in that it generically describes a piece of wire bent in a complicated curve.

While there has been shown and described what are at present considered the preferred embodiments of the invention, it will be obvious to those skilled in the art that various changes, alterations and modifications may be made therein without departing from the scope of the invention as defined by the appended claims.

What is claimed is:

1. A coupling system for delivering microwave power to a lamp capsule comprising:

a first loop applicator having a first partial turn having a first end and a second end and a second partial turn having a first end and a second end wherein the first turn and second turn form planes which are parallel to and separated from each other, a third partial turn forming a plane which is orthogonal to the parallel planes of the first and the second partial turns in which the third partial turn attaches at one end to the second end of the first partial turn and at a second end to the second end of the second partial turn;

a second loop applicator having a first partial turn having a first end and a second end and a second partial turn having a first end and a second end wherein the first turn and the second turn form planes which are parallel to and separated from each other, a third partial turn forming a plane which is orthogonal to the parallel planes of the first and second partial turns in which the third partial turn attaches at one end to the second end of the first partial turn and at a second end to the second end of the second partial turn wherein said first and said second loop applicator are positioned to face each other and form a gap;

a planar transmission line having a first end and a second end, the first end of the transmission line being attached to the first end of the first partial turn of the first loop applicator and the first end of the second partial turn of the first loop applicator, the second end of the transmission line being attached to the first end of the first partial turn of the second loop applicator and the first end of the second partial turn of the second loop applicator wherein the transmission line forms a balun so that a voltage at the first loop applicator is 180° out of phase at the second loop applicator.

2. The coupling system according to claim 1 wherein the first and second loop applicators are coupled to a single microwave power source.

3. The coupling system according to claim 1 wherein the first and the second loop applicators are each formed from a single piece of wire.

4. The coupling system according to claim 3 wherein the wire is selected from the group consisting of copper, nickel and tungsten.

5. The coupling system according to claim 3 wherein the first and the second loop applicator are made from tungsten gold alloy.

6. The coupling system according to claim 1 wherein the first and the second loop applicators are made from a high temperature superconducting ceramic.

7. The coupling system according to claim 1 further comprising a ground plane parallel to the first and the second ends of the planar transmission line wherein the plane formed by the third partial turn of said first loop applicator forms a dihedral angle between 0° and 135° with the ground plane and the plane formed by the third partial turn of said second loop applicator forms a dihedral angle between 0° and 135° with the ground plane.

* * * * *